US010109410B2

(12) United States Patent
Krusor et al.

(10) Patent No.: US 10,109,410 B2
(45) Date of Patent: Oct. 23, 2018

(54) OUT OF PLANE STRUCTURES AND METHODS FOR MAKING OUT OF PLANE STRUCTURES

(71) Applicant: Palo Alto Research Center Incorporated, Palo Alto, CA (US)

(72) Inventors: Brent S. Krusor, Fremont, CA (US); Christopher L. Chua, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 15/407,806

(22) Filed: Jan. 17, 2017

(65) Prior Publication Data

US 2018/0204662 A1 Jul. 19, 2018

(51) Int. Cl.

| | |
|---|---|
| ***H01R 43/16*** | (2006.01) |
| ***H01H 5/00*** | (2006.01) |
| ***H01F 27/28*** | (2006.01) |
| ***H01F 41/04*** | (2006.01) |
| ***H01F 5/00*** | (2006.01) |

(52) U.S. Cl.

CPC ..... *H01F 27/2804* (2013.01); *H01F 5/00* (2013.01); *H01F 41/042* (2013.01); *H01R 43/16* (2013.01)

(58) Field of Classification Search

CPC .. H01F 5/00; H01F 27/00–27/36; H01F 43/16
USPC ..... 336/65, 200, 225–228, 232; 29/874–877, 29/842, 882
See application file for complete search history.

(56) References Cited

U.S. PATENT DOCUMENTS

| | | | | |
|---|---|---|---|---|
| 5,256,262 | A | 10/1993 | Blomsterberg | |
| 6,527,920 | B1 | 3/2003 | Mayer et al. | |
| 6,534,249 | B2 | 3/2003 | Fork et al. | |
| 6,558,231 | B1 | 5/2003 | Taylor | |
| 6,582,989 | B2 * | 6/2003 | Biegelsen | H01F 17/0006 336/200 |
| 6,646,533 | B2 | 11/2003 | Biegelson | |
| 6,793,797 | B2 | 9/2004 | Chou et al. | |
| 6,848,175 | B2 | 2/2005 | Fork et al. | |
| 7,000,315 | B2 * | 2/2006 | Chua | H01F 17/02 257/E21.022 |
| 7,128,821 | B2 | 10/2006 | Lin et al. | |
| 7,189,647 | B2 | 3/2007 | Patton et al. | |

(Continued)

*Primary Examiner* — Tuyen Nguyen
(74) *Attorney, Agent, or Firm* — Hollingsworth Davis, LLC

(57) ABSTRACT

A method for forming an out of plane structure includes depositing a layer of an elastic material on a substrate wherein the elastic material has an intrinsic stress profile. The layer of elastic material is photolithographically patterned into at least two spaced-apart elastic members. An electrically non-conductive tether layer joins the elastic members. A portion of the substrate is etched under the elastic members to release a free end of each elastic member, while leaving an anchor portion of each elastic member fixed to the substrate. The stress profile of the elastic members biases the free ends of the elastic members away from the substrate forming loops. The structure is electroplated by applying a voltage having a first polarity between an anode and the structure while the structure is in an electroplating bath. Subsequent to the electroplating, the polarity of the voltage between the anode and the structure is reversed.

16 Claims, 10 Drawing Sheets

(56) References Cited

U.S. PATENT DOCUMENTS

| | | | |
|---|---|---|---|
| 7,713,388 | B2 | 5/2010 | Chua et al. |
| 2003/0155255 | A1 | 8/2003 | Yahalom |
| 2005/0224358 | A1 | 10/2005 | Kwak et al. |
| 2006/0049056 | A1 | 3/2006 | Wang et al. |
| 2011/0272288 | A1 | 11/2011 | Lin |

* cited by examiner

OUT OF PLANE STRUCTURES AND METHODS FOR MAKING OUT OF PLANE STRUCTURES

TECHNICAL FIELD

This disclosure relates generally to electrical micro-device structures and to methods for making such structures.

BACKGROUND

Out-of-plane inductors offer several advantages over prior art planar inductors, in that out-of-plane structures minimize eddy currents induced in the underlying substrate and when out-of-plane coils are operated at high frequencies, skin and proximity effects are better controlled. Out-of-plane coil structures place the coil axis parallel, rather than perpendicular, to the substrate plane.

BRIEF SUMMARY

According to some embodiments, a method of forming an out of plane coil structure includes depositing a layer of an elastic material on a substrate such that the elastic material has an intrinsic stress profile. The layer of elastic material is photolithographically patterned into at least two spaced-apart elastic members. An electrically non-conductive tether layer is formed which joins the at least two elastic members. A portion of the substrate is etched under the elastic members and the tether layer to release a free end of each of the elastic members and the tether layer from the substrate while leaving an anchor portion of each of the elastic members fixed to the substrate. The intrinsic stress profile in each elastic member biases the free end of the elastic member away from the substrate to form a loop upon release of the free end. The tether layer maintains the spaced apart position of the loops with respect to one another. The out of plane structure is electroplated by applying a voltage having a first polarity between an anode and the structure while the structure is in an electroplating bath. Subsequent to the electroplating, the out of plane structure is exposed to an electrolytic solution. At least some of the plating material is removed from the electrically non-conductive tether layer by reversing the polarity between the anode and the structure while the structure is in the electrolytic solution.

A method for forming an out of plane structure includes depositing a layer of an elastic material on a substrate wherein the elastic material has an intrinsic stress profile. The layer of elastic material is photolithographically patterned into at least two spaced-apart elastic members. According to some embodiments, an electrically non-conductive tether layer joins the elastic members. A portion of the substrate is etched under the elastic members to release a free end of each elastic member, while leaving an anchor portion of each elastic member fixed to the substrate. The stress profile of the elastic members biases the free ends of the elastic members away from the substrate forming loops. The structure is electroplated by applying a voltage having a first polarity between an anode and the structure while the structure is in an electroplating bath. Subsequent to the electroplating, the polarity of the voltage between the anode and the structure is reversed.

In accordance with some embodiments, a structure includes a substrate and a coil structure disposed on the substrate. The coil structure includes a plurality of anchor portions disposed on the substrate and a plurality of electroplated coil windings electrically connected in series, each winding comprising an electrically conductive elastic material having an intrinsic stress profile that biases a free end of the coil away from the substrate, each coil electrically connected to a respective anchor portion. An electrically non-conductive tether joins the plurality of coil windings and maintains a spaced apart distance of the coil windings with respect to one another, wherein a minimum distance between the coil windings is less than about 100 μm.

These and other aspects of the present application will be apparent from the detailed description below. In no event, however, should the above summaries be construed as limitations on the claimed subject matter, which subject matter is defined solely by the attached claims.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1:
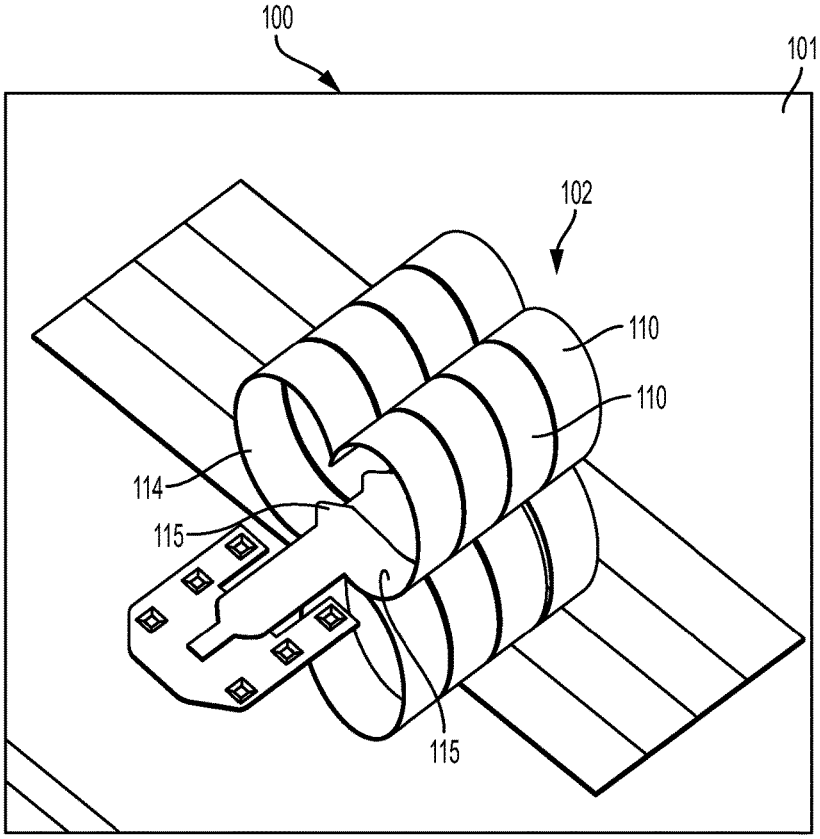
FIG. 1 is a perspective view of an out of plane structure comprising a microfabricated on-chip 3D inductor comprising a substrate and coils disposed on the substrate in accordance with some embodiments.

One of the key challenges in Radio Frequency Integrated Circuits (RFIC) is the availability of high Q-factor inductors that can be integrated on-chip with other RF electronics. Q-factor is a measure of energy loss during operation, and it determines how well an inductor can perform as part of a resonant circuit. Many RF circuits, such as those used in filters and in voltage controlled oscillators, require high Q-factor (low loss) inductors in order to define sharp resonant frequencies and function as designed. In other circuits such as RF power amplifiers and power converters, higher Q-factor inductors translate to lower power operation.

Most inductors that can be integrated on-chip have a pancake architecture, where the coil windings are made on the same plane as the wafer surface. In such structures, the magnetic field is oriented into the substrate, inducing eddy currents and resulting in energy loss. To attain high Q-factor performance, the coil windings (also referred to as loops) are closely spaced and are oriented out of the wafer plane perpendicular to the wafer surface.

Embodiments described herein are directed to out of plane structures and methods for making out of plane structures. In some embodiments the out of plane structures are coil structures comprising coil windings that self assemble due to electrically conductive elastic members that have an intrinsic stress profile. Due to their intrinsic stress profile, when released from the substrate the elastic members curl to form out of plane coil windings. The electrically conductive coil windings may optionally be held in a spaced apart configuration by non-electrically conductive tethers that connect the coil windings. After the coil structures are self-formed in the manner described above, the coil structures are electroplated for electrical connection and/or to increase the electrical conductivity of the coil windings. The electroplating has unexpectedly been found to result in plating material that extends along the non-electrically conductive tethers causing shorts between the coil windings. It has also been discovered that the plating material extending along the non-conductive tethers can be removed by reversing the polarity of the plating step. The approaches described in this disclosure allow for fabrication of an out of plane, high Q factor micro-coil structure with Q factor greater than about 10 and adjacent coil windings that are separated by less than about 100 um.

Coil windings are made by introducing an intrinsic stress profile of a certain amount into the elastic members that is designed to produce the desired coil winding height and curvature. A reproducible built-in stress gradient or intrinsic stress profile can be designed into a thin film by varying the growth conditions appropriately during deposition to produce coil windings, i.e., a released elastic member which bends back on itself producing a coil winding and contacting the substrate. By using or adding one or more conductive layers, electrically connected coil windings suitable to form an inductor or a transformer may be manufactured.

FIG. 1 is a perspective view of a coil structure 100 comprising a microfabricated on-chip 3D inductor. The coil structure comprises a substrate 101 and a coil 102 disposed on the substrate 101. The individual coil windings 110 of the coil 102 are out of plane with respect to the substrate 101. The coil 102 includes a plurality of anchor portions 115 disposed on the substrate 101. A plurality of electroplated coil windings 110 that are out of plane with respect to the substrate 101 are electrically are connected in series. Each coil winding 110 comprises an electrically conductive elastic material having an intrinsic stress profile that biases a free end of the coil winding 110 away from the substrate 101. Each coil winding 110 is electrically connected to the substrate 101 by a respective anchor portion 115.

An electrically non-conductive tether 114 joins the plurality of coil windings 110 and maintains a spaced apart distance of the coil windings 110 with respect to one another such that a minimum distance between the coil windings 110 is less than about 100 μm. In some embodiments, a ratio between a width of the coil windings 110 and a minimum distance between the coil windings 110 is greater than about 2.

The coil structure 100 may be fabricated using standard wafer-scale processing techniques, and can be batch-fabricated on integrated circuit wafers as an add-on process. During operation, the 3D out-of-plane coil windings orient the magnetic field parallel to the substrate surface, resulting in low energy loss and high quality-factor performance.

The coil 102 is fabricated by releasing patterned stress-engineered thin films from the substrate 101. The film curls up from opposite ends and self-assembles in air to form coil windings 110. The resulting 3D structure forms a scaffold that is then electroplated with highly conductive metal, such as Cu. The plating process joins the seams where two opposite coil windings meet. It also patches perforations employed for releasing the film from the substrate. The plated metal makes the 3D structure robust, and it makes the coil winding highly electrically conductive.

Figure 2:
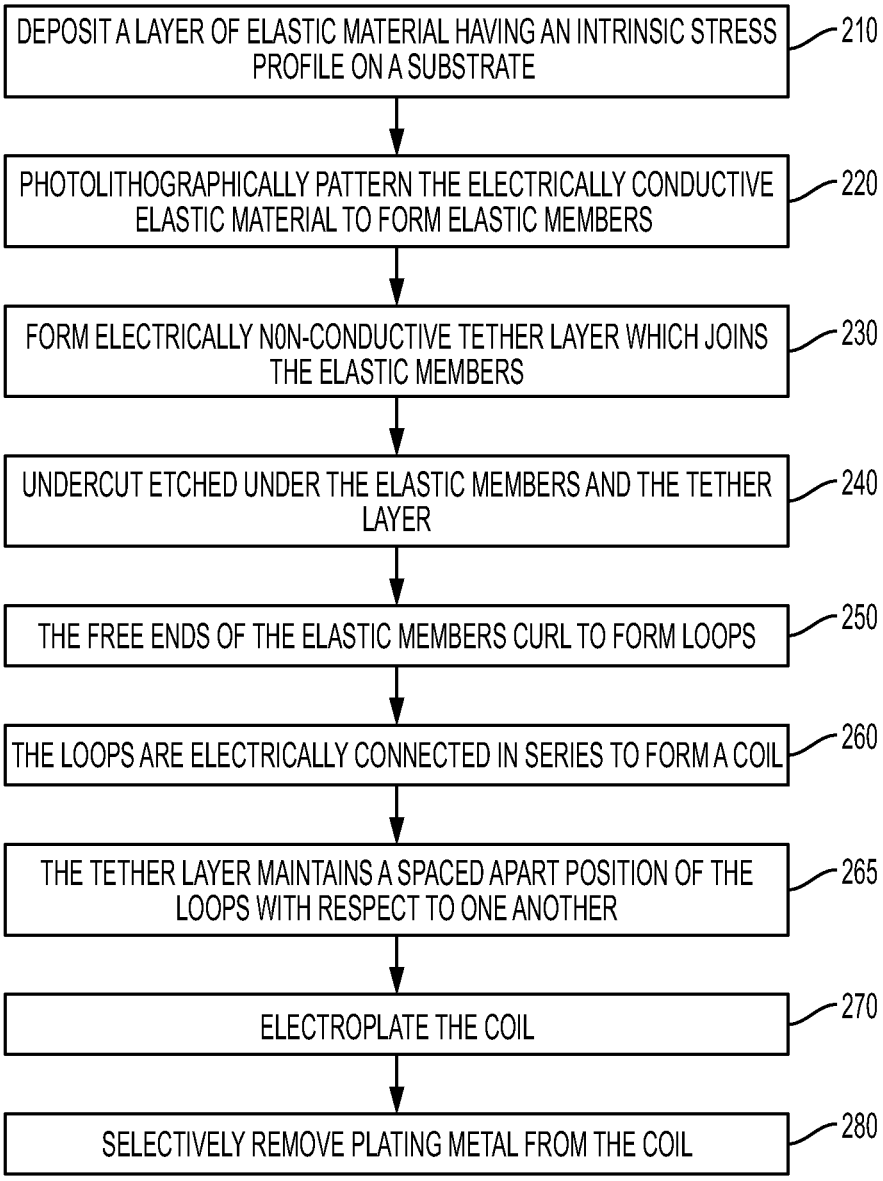
FIG. 2 is a flow diagram of a process for making an out of plane structure in accordance with some embodiments.

FIG. 2 is a flow diagram of a process for making an out of plane structure in accordance with some embodiments. A layer of elastic material having an intrinsic stress profile is deposited 210 on a substrate. The layer of electrically conductive elastic material is photolithographically patterned 220 into at least two spaced apart elastic members. An electrically non-conductive tether layer is formed 230 which joins the two elastic members. A portion of the substrate is undercut etched 240 under the elastic members and the tether layer to release a free end of each of the elastic members and the tether layer from the substrate, while leaving an anchor portion of each of the elastic members fixed to the substrate. The intrinsic stress profile in the elastic members biases the free ends of the elastic members away from the substrate. Upon release of the free ends the elastic members curl 250 to form loops (coil windings). The coil windings are electrically connected 260 in series to form a coil. For example, in the embodiment shown in FIG. 1, the free ends of opposing half loops are electrically connected to form the coil windings if a coil. In some embodiments, the free end of each half loop is joined to an anchor portion attached to the substrate.

In some embodiments, a tether layer is used which maintains 265 a spaced apart position of the coil windings with respect to one another. The coil is electroplated 270 by applying a voltage between an anode and the coil while the coil is immersed in an electroplating bath. Subsequent to the electroplating, the plating metal is selectively removed 280 from the electrically non-conductive tether layer by reversing a polarity of the voltage between the anode and the coil structure while the coil structure is in an electrolytic solution. In some embodiments, the electroplating bath is the same as the electrolytic solution. For example, after the electroplating, the coil structure may be physically removed from the electroplating bath and placed into the electrolytic solution which is chemically different from the electroplating bath. In another example, the coil structure may not be physically removed, but the electroplating bath is chemically altered to form the electrolytic solution. In some embodiments, the electroplating bath is chemically the same as the electrolytic solution. When the polarity is reversed, a reverse current density of between about 10 $ma/cm^2$ and about 20 $ma/cm^2$ is applied for a time period of about 0.5 and 2.5 minutes. For example, a reverse current density of about 10 and 20 $mA/cm^2$ for about 1.5 minutes may be applied. In some embodiments about 600 nm of plated copper is removed. In some implementations, the reverse current can be pulsed, e.g., transitioning from zero current to a reverse polarity current with a value greater than zero a duty cycle of between about 20% to about 80% or about 50%. In some embodiments a forward polarity current (electroplating) and a reverse polarity current (reverse plating) are alternately applied in sequence.

The reverse polarity may be applied on a Pt-clad anode relative to the plated coil and wafer. The reverse plating process can be performed at room temperature with moderate stirring. The reverse plating process may be applied for the duration necessary to remove about 15% to 20% of previously plated metal, wherein the plated metal may be Cu, for example.

For pulsed current, the collective current pulse time that the reverse polarity is applied may be about 1.5 minutes (e.g., for a 50% duty cycle, 1.5 minutes of pulse time between zero and negative polarity would occur over a total time of 3 minutes.) As previously discussed pulsed current may be used to remove about 600 nm of plated copper and/or about 15% to 20% of previously plated metal.

In some embodiments, the anode may comprise a 0.031" diameter wire having a copper core that is surrounded with 0.0035" of Nb and cladded with an outer 25 micro-inch thick layer of Pt. The Cu core provides the desired high electrical conductivity. The Nb shell allows for sufficient mechanical and electrochemical protection of the core. The outer Pt cladding protects against corrosion under anodic condition, while allowing current to pass without forming an insulating film.

According to some embodiments, the anode may comprise a Pt-clad titanium mesh having dimensions of about 2"×2", with a Pt thickness of about 100 micro-inches. The larger area of the mesh anode can provide a more uniform current density across the sample surface which compared with the wire anode previously described.

In some embodiments, the electrolytic solution used for the reverse plating process comprises phosphoric acid having a concentration in a range of about 70% to about 90%. In some embodiments, the electrolytic solution comprises phosphoric acid having a concentration of about 85%. In some embodiments, about 15% to about 20% or about 400 nm to about 800 nm of the plating metal is removed from the coils during removal of the plating metal from the tether.

The methods and structures disclosed herein employ some of the same techniques disclosed in U.S. Pat. Nos. 7,713,388, 7,000,315, 6,856,225, 6,646,533, 6,392,524, 5,613,861, 5,848,685, and 5,914,218 which are all incorporated herein by reference. Coils or springs are made by introducing an intrinsic stress profile of a certain amount designed to provide the desired coil winding or spring height and/or curvature. A reproducible built-in stress profile can be designed into a thin film by varying the growth conditions appropriately during deposition to produce coil structures that are "self-assembling." Self-assembling coil structures include released elastic members which bend back on themselves producing coil windings. By using or adding one or more conductive layers, a coil structure suitable for use as an inductor or transformer may be manufactured.

Figure 3:
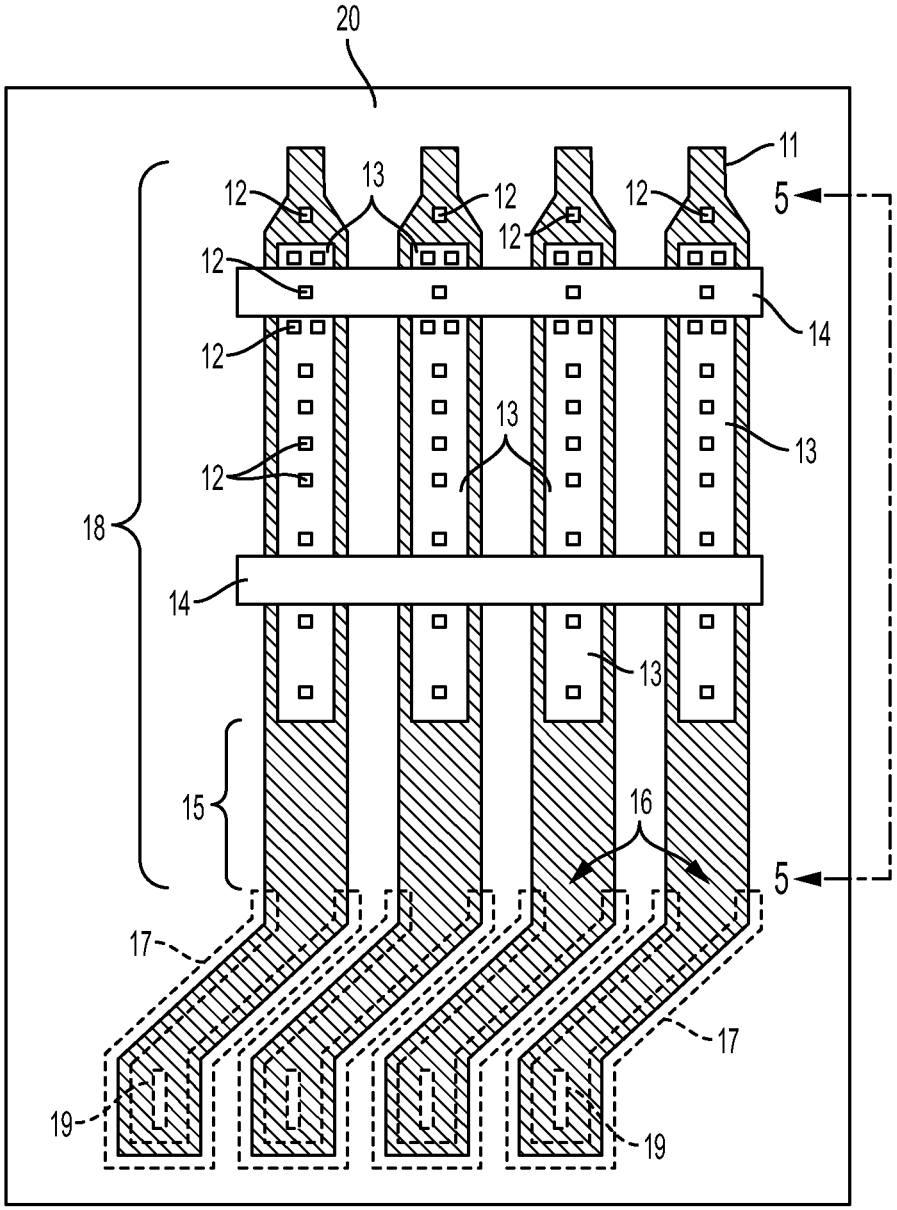
FIG. 3 is a top view of a layout of four tethered elastic members before release in accordance with some embodiments.
Figure 5:
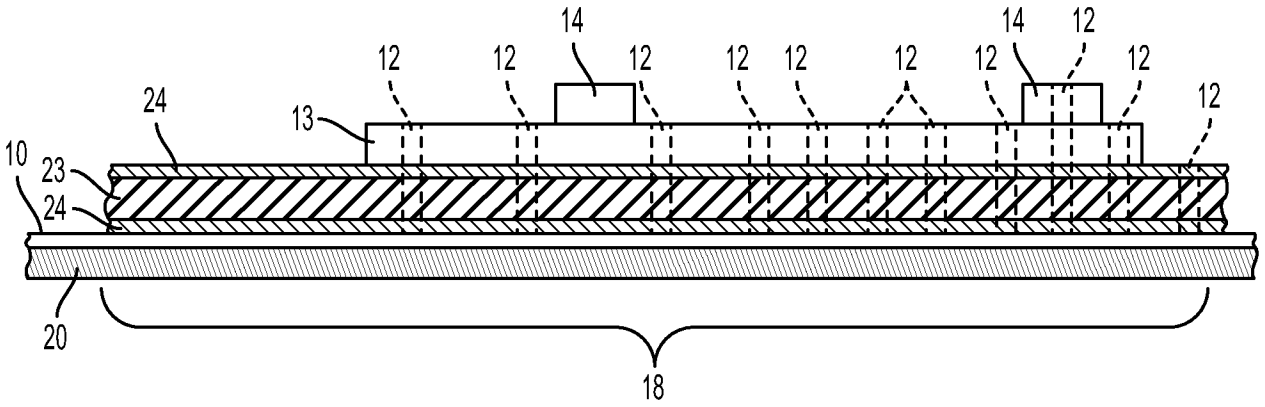
FIG. 5 is a cross section along line 3-3 of FIG. 3.

Referring to FIGS. 3 and 5, in some embodiments the layer of elastic material 10 may comprise Ti, Si, or SiN and is patterned on substrate 20. The substrate may be any material that can survive the processing conditions, which includes a wide variety of materials due to the inherently low process temperatures involved in the fabrication of stress engineered materials. These substrate materials include glass, quartz, ceramic, silicon and gallium arsenide, as well as substrates with existing passive or active devices. The release layer 10 may be a material that can be quickly removed by selective dry or wet undercut etching. Possible etchants for a Si release layer include KOH (wet processing) and XeF2 (dry processing). Hydrofluoric acid will etch Ti or SiN release layers.

A layer of an elastic material is deposited on substrate 20 and patterned into four individual elastic members or fingers 18. Each finger 18 can be formed of a single elastic material 23, such as a stress graded film of NiZr, Mo/Cr, solder-wettable Ni, or other suitable material. Alternatively, each finger 18 can be formed of two or three layers: a bottom gold layer 24, for example, can be used to form the outer skin of the coil windings when released and provides a high conductivity path for electrons at high frequencies. A second gold layer (not shown) can be deposited on top of layer 23 to passivate the surface. The added layers may also serve as a seed layer for subsequent plating. Depending on the design required, any metals capable of holding large stresses may be used to form the parts of the finger that induce bending, and clad them with additional layers that are good seed layers for plating. Alternately, the stresses may be placed into a material that contains the required bending moment and is also suitable for plating and/or soldering, for example Ni or its solution hardened alloys.

Figure 8:
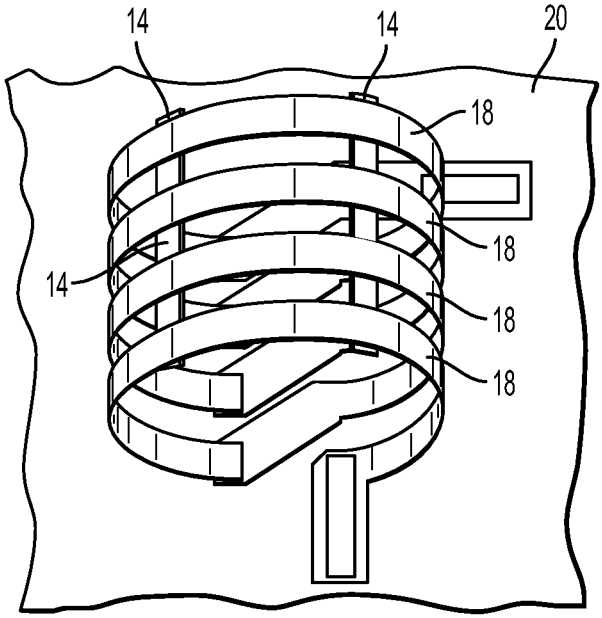
FIG. 8 is partial perspective view of the tethered elastic members of FIG. 3 after release and formation of coil structures.

Referring to FIG. 3, two cross tethers 14 were deposited and patterned to connect or join at least from one released elastic member 18 in the array of four fingers 18 to one additional released elastic member 18 in the array. Tethers 14 are shown as substantially perpendicular to the length of members 18, but may be disposed diagonally or some other convenient orientation for maintaining the spaced-apart separation of the released elastic members. The release mask 17 allows a release etch to undercut both the released elastic members 18 and the tether 14. Although two tethers 14 are shown in FIGS. 3 and 5, only one may be used or more than two may be used. In some embodiments tethers are not used. The tether 14 may be perforated with one or more perforations 12 to allow release etchant to pass through the tether layer 14 through an aligned hole 12 in the elastic member layer 18 in order to more rapidly release the finger 18. In FIG. 3, a tether layer 14 is placed near the four tips 11; a second tether layer 14 is placed near the center of the fingers 18. FIG. 8 shows the released elastic members 18 formed into connected windings with tether layers 14 still in place.

The tether layers minimize or eliminate the floppiness problem of very long flexible released elastic members (the longer the released elastic members, generally the greater the problem). Longer, thinner released elastic members also have a tendency to intertwine after release. By placing cross-tethers on the elastic members that release along with the elastic members, this problem is also eliminated. The tethers are made narrow enough to ensure that release etch releases them along with the elastic members. The tethers maintain uniform released elastic member element array spacing and prevent the released elastic members from touching or entangling after release and when the tips are being connected to their respective pads. The ensemble of tethered released elastic members behaves like an effectively stiffer structure. The tether material should be non-conducting in order to provide electrical isolation of electrically conductive released elastic members. Example tether materials include photodefinable Benzocyclobutene (BCB).

The out-of-plane coil structures are particularly beneficial when used as inductors or transformers in integrated circuits. While the individual released elastic members may be formed of a metal stress graded material, or multi-layers of metal and stress graded material, in many applications, the structure will be plated with metal in a plating bath after the released elastic members are released and the free ends connected to the contact pads. As described below, resist reflow is used to protect certain areas of the structure from the plating bath. The reflow step could also be used to reflow the tethering material, particularly if the tether material is the same as the reflow material. If the amount of reflow is too large, the tethers could neck down and even separate into drops of resist on each finger. To avoid this, a separate mask can be used to define the tether layer, or the tether layer can be combined with the load layer (if a load layer is added to the structure—as described below) into a single layer separate from the release layer. If, for example, the release layer is made of resist, the tether-load layer could be made of polyimide. Reflow of the resist would not reflow the polyimide, because of the wide separation of their glass transition temperatures.

When a separate tether-load layer material is used, when the release window 16 is removed the exposed release metal that was used as a common cathode can be cleared away. The tethers may remain in place for this and subsequent dicing and packaging steps because although the plating step stiffens the released elastic members, once the tethers are removed, individual released elastic members may bend into adjacent loops.

If the tethers are combined into the release window mask, no added mask count is needed to implement the tether layer, reducing cost. The tethers proposed can be implemented in the release window material that in the process flow serves to define where the released elastic members lift and also where the electroplating occurs. If the tethers are not combined with the release mask, then a three mask process may be needed, which is still possible to implement at low cost.

The rate of Ti release layer undercut below both released elastic member metal and photoresist has been characterized. The undercut rate in the release etch under both released elastic member and tether materials is identical and rapid. Release times for released elastic members with 200 nm Ti is on the order of 0.34 microns/sec, meaning that 50 micron wide released elastic members take about 74 seconds to release. Tethers having a width narrower than 50 microns will release during the same process. Much narrower tethers may be used, on the order of 20 microns; these tethers will interfere even less with the release process. Tethering effectively reduces the length-over-width ratio of the released elastic member segment. The inventors have demonstrated a high yield without bunching or tangling is routine if length/width limits are not exceeded.

After release and closure of the coil windings, the tethers are located on the inside of the coil windings of the coil. At high frequencies, currents flow on the outside of the coil windings (made of an electrically conductive material) due to the skin effect. To avoid shorting between adjacent coil windings formed of an electrically conductive material, the tether material should be made of a non-conductive material. The inventors have found that electroplating occurs along the insulating tether, resulting in shorts between the coil windings. The shorts between windings may occur, for example, if there is small amount of contamination in the electroplating bath that inadvertently lands on the tethers. These contaminants then seeds plating of Cu (or other material) onto undesirable areas. This parasitic plating is slower than plating of the main areas, but becomes especially significant and problematic if thick plated coatings are needed on the main areas.

In various embodiments, the tethered coil windings may be linear or may be square or rectangular toroids or may have other shapes. The use of tethers is not limited to coil structures. Any cantilever structure that requires additional constraint to overcome problems associated with floppiness will benefit from tethering. In particular, in structures such as probes and packages, where the cantilever may be further stiffened by subsequent electroplating, or constrained by flip chip contact, the tethers can serve to make the process more robust. The use of tethers can be combined with one or more of the following additional embodiments of the invention, or one or more of the following additional embodiments may be used alone.

In accordance with another embodiment of this invention, a graded density of perforations 12 disposed along the length of the elastic members 18 may be used to control the rate of release of the elastic members 18. FIGS. 3 and 5 show one way in which a graded perforation density may appear in the layout of a coiled spring array. Note that the spacing between perforations 12 is increased gradually from the tip 11 to the base of the elastic member 18. Note also that, if a load layer 13 (described below) is also present, perforations 12 in the loaded section 13 of the elastic member 18 go through both the load layer and elastic member layers 23 and 24.

The graded perforation density in elastic members 18 enables the release from the substrate to be in a controlled fashion starting with the tip 11, and progressing toward the base. This has significance because of the large amount of elastic energy that is stored in the elastic member before release. If the release rate of the energy is too rapid, the elastic member can reach enough speed to entangle with other elastic members or break. Gradual release of the elastic member allows mechanical damping enough time to limit the total kinetic energy of the elastic member 18 to a non-destructive level.

Perforations may also be used to create varied inductance values from one individual coil winding to another or from a series of coil windings to another. Typically, for a given thin film deposition sequence, only one coil area is created. This happens because typically only one main radius is created, and if a load layer is used, one loaded radius. To obtain different inductance values, the number and pitch of the windings must be varied. The number of windings can only be varied discretely, hence, the pitch must be used to fine tune inductance values for a given winding area. If a design calls for more than one inductance, then there will be varied finger widths. To ensure that the fingers all release at approximately the same time, with the same release layer undercut, the use of graded density perforations, with the same approximate densities is required. The graded perforation density can be used to ensure that all elastic members release at the same rate, regardless of width.

Tethers may be used in addition to the graded perforation density. In some cases, it may be possible to locate the tether layers in between perforations. In other cases however, if the tether must pass over a perforation, that area of the tether must be either removed or perforated so that the release etch is not blocked. If a load layer is present, the perforation should pass through the load layer so that release etch is not blocked. In some embodiments, structures pertaining to the load layer that are present during elastic member release would not block the release etch from passing through the elastic member perforations. This typically calls for making perforations in both the spring definition mask and in the load layer definition mask in order to define an operational perforation 12.

Load layers have been used to vary the radius of curvature of the elastic member. The load layer 13 is an additional layer patterned on the elastic member 18 to apply stress that either increases or decreases the bending radius. The load layer 13 is patterned to reside generally in the middle segment of the elastic member 18. The load layer is typically made of metal, such as gold, Mo, MoCr alloy, Ni, Ni alloy etc.

The inventors have determined that a load layer made of a reflow material such as photoresist can be advantageously used to load elastic members 18 to increase the radius in comparison to the same beam without the resist. The resist can be introduced in the same masking step that creates the release window, or it can be introduced in a separate step. The resist has very low intrinsic stress when it is processed. Once the elastic member is released, the resist is typically on the inside of the bending cantilever, and therefore it accumulates compressive stress as it opposes the bending. One desirable feature of the resist is that the loading effect of the resist can be gradually changed with either heat or plasma ashing. Heat permits the resist to soften, and above its glass transition temperature, to flow. For Shipley 1813 resist, it was observed that the loading effect was substantially reduced at 185 C., and was further reduced at 200 C. The loading effect can be substantial. In one experiment, the inventors altered the released elastic member diameter from 495 down to 345 microns.

Plasma ashing of the photoresist load layer 13 is another way to control the released elastic member diameter. Ashing permits gradual controlled reduction of the resist thickness without attacking the metal of the elastic member. As the resist thickness is reduced, the diameter shrinks.

The resist defining the release window will typically be reflowed in order to seal off the edge of the release metal to block plating along the edge of the window. This reflow step may relax some or all of the load created by the loading resist. If desired, the load layer resist and the release window resist can be two separate materials with different glass transition temperatures.

Using a load layer formed of a reflow material such as resist, increases the stiffness and radius of the released elastic members while they are still in the release etch. Once the released elastic members are removed and dried, the reflow step tightens the radii. This can be performed in air, where there is reduced likelihood of sticking or entangling. The trajectory of the free end of each cantilever is therefore determined by a two step process of first releasing the elastic member and then reflowing a reflow load on the released elastic member. This two step trajectory is preferred because the step of placing the tip to its target contact point can be done slowly and in air in the absence of surface tension forces.

As discussed in U.S. Pat. No. 6,856,225, a load layer of sputtered material, preferably metal, can be introduced to produce a loaded section of an acircular beam. The loading effect of the metal can be controlled by selecting the layer thickness, intrinsic stress and modulus. Since it is desirable to keep the layers thin in order to minimize etch times and undercut, utilization of non-zero stress to minimize the amount of metal needed may be advantageous. For a given material, the elastic modulus is fixed, however, the stress may be controlled to reduce the required thickness. For example, a compressive load applied to the inside surface of a beading beam will expand the radius of the beam more than a neutral or tensile load.

The width of the load layer can be varied in order to adjust the amount of change induced in the released elastic member. For example, by applying a load layer that exactly balances the bending moment of the released elastic member when its width equals that of the released elastic member, the radius of the loaded elastic member can be varied from infinity down to the released elastic member's natural radius by varying the width of the load layer. Different coils, or different segments within released elastic members can have different radii without introducing more than one load layer by simply altering the load layer width.

To control the thickness of the load layer and the resulting stress, the load layer may be a multilayer. The layers that comprise the released cantilever can include a bottom layer of seed metal for plating, the layers of stressed metal of the elastic member, a top layer of seed metal, a layer of load metal, and additional seed metal in case plating is desired on the loaded segment. The load layer may be fabricated from the same material as the metal of the elastic member. This simplifies the processing. All of the layers can be deposited in the same deposition apparatus by sequential deposition.

Gold can be used as the seed metal for plating. The seed metal will have some loading effect of its own. It is possible therefore to load the beam with the multiple layers of seed metal. Gold is soft however, and has a smaller modulus and yield stress than the metals typically used for the coil windings. More efficient loading can be achieved with metals such as MoCr. Ni and Cu are also possible seed metals for plating, and may have a cost advantage over gold.

Figure 14:
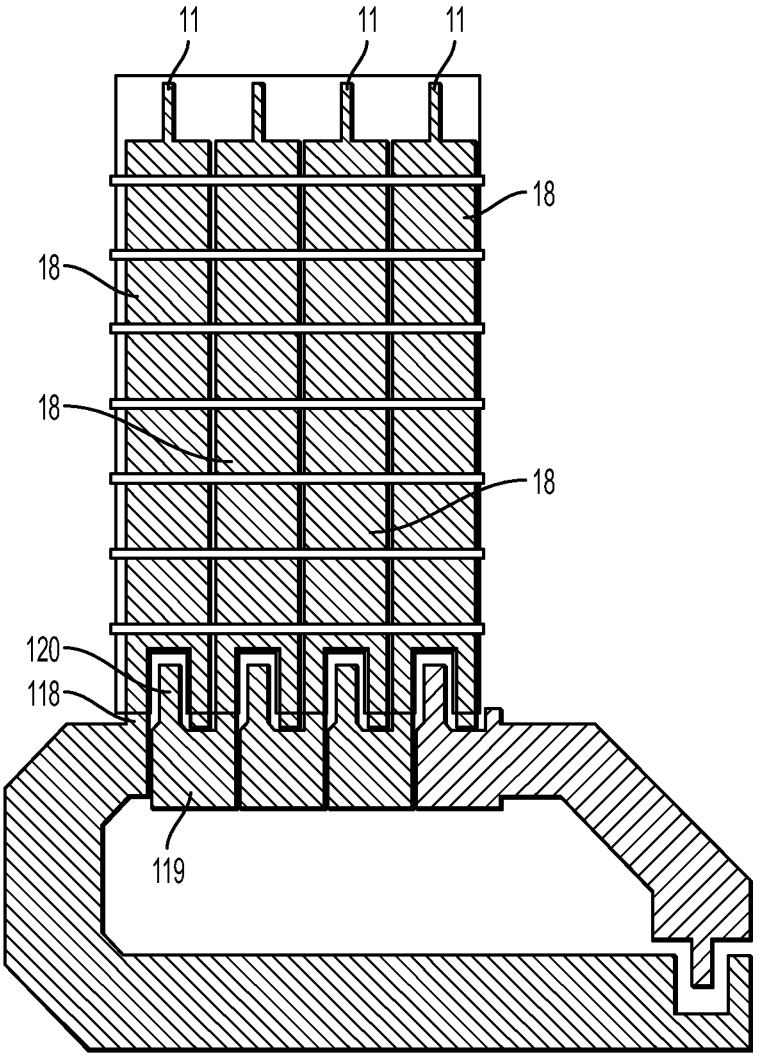
FIG. 14 is a top view of yet another alternative layout of four elastic members before release in accordance with some embodiments.

One configuration for making a multi-turn coil out of a series of individual coil windings is to pattern the base of the elastic member in the shape of an inverted "Y" or "U". Referring to FIG. 14, elastic members 18 include inverted base pads 118 (in the shape of a "U"). The contact pad 119 for an adjacent loop can then be positioned within the space provided by the "Y" or "U" configuration of base pad 118. One way to increase the yield of the Y-spot loop (as discussed in U.S. Pat. No. 6,856,225) is to extend a narrow tip 11 on the elastic member 18 to allow this tip 11 to bisect an extended portion 120 of the Y past the contact pad 119. This permits coil completion without shorting, even if the radius is tighter than required to stop the free end 11 at the contact pad 119. It is worth noting that since the inductance is proportional to the loop area which varies quadratically with radius, the percentage error in inductance is twice the percentage error in radius.

This sensitivity to radius error is of concern for several reasons. First, process non-uniformity within the sputter tool will produce some variation in the radius within a wafer and from wafer to wafer. Further variations can occur from run to run. It is highly desired to reduce the sensitivity of the loop area to process variations that cause the actual radius to deviate from the design radius. One way to achieve this is to cause the free end to hit a mechanical stop of some kind. This forces the coil area to depend on physical layout variables rather than process variables. The mechanical stop can take a variety of forms, and provide several levels of constraint.

Figure 4:
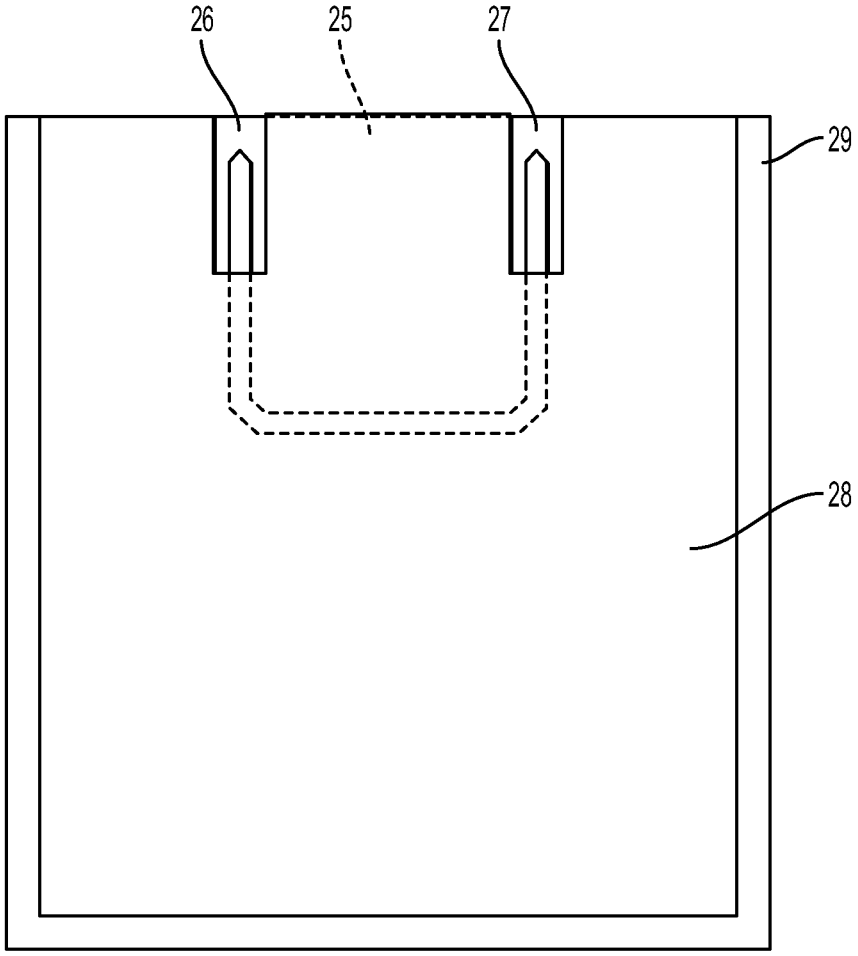
FIG. 4 is a top view detail of a raised mechanical stop on a contact pad in accordance with some embodiments.

One simple constraint illustration is provided by the acircular loaded beam. By simply loading a forward segment of the elastic member 18 (such as by depositing a load layer 13 to a smaller length than shown in FIG. 3), the tip 11 is forced to hit the substrate rather than wrapping inside the coil. The substrate provides a degree of mechanical constraint on the tip since the tip cannot penetrate the substrate. The free end tip 11 can still slide on the surface. To constrain the tip 11 further, a raised stop 25 on the surface of the landing pad can be introduced to prevent the free end from sliding closer than a given distance towards the take-off point. Further, lateral raised stops 26, 27 (FIG. 4) can be placed to either side of the landing pad to guide the tip 11 and to prevent it from sliding to either side. The edges of the lateral stops can further be tapered in a horn like structure to gather the free end 11 of the finger 18 and funnel it into its desired location. The mechanical stops should not block the entire cross section of the pad available for plating, since this might create a segment of high resistance in the coil. To produce a stop, it is only necessary for the stop to touch a portion of the free end 11 in order to constrain its movement. Tip 11 is shown as tapered to facilitate positioning and final connection to the contact pad.

The stop can be formed from a released elastic member. If formed from a released elastic member, no additional masks are needed to make the stop. A loop formed by such a structure will have a long elastic member and a short elastic member or tab. The long and short elastic members can interlock with each other to constrain their positions. Additionally, the design can provide for the long elastic member touching both the short elastic member and the substrate if desired. Design constraints may be included in the coil such that errors in the fully relaxed radii of the segments do not produce proportionate errors in the coil cross-section. Structures that close until they hit a stop and then stop without fully relaxing have this desired property.

In addition to or in place of a mechanical stop, a tacking operation that adheres the tip in its desired location prior to plating is a useful structure for improving device yield. By tacking the tip in place, it is less likely that the electroplating bath can move the tip 11 before the electroforming operation solidly anchors the tip. The tacking can be achieved for example by melting and flowing a small amount of material between the tip and pad, and then hardening it. This would be the natural outcome of designing in a small amount of release window material at the contact point. The reflow operation described above will also tack the tip in place. This can therefore be implemented with no change in cost. The tacking area is intentionally kept small to minimize the contact resistance. The tethers further serve to ensure that the tips that are not fully tacked remain in proximity to the pad. FIG. 3 item 19 shows a strip of release window material that could be used to tack the tip in place.

It is highly desirable to be able to tune the radius of the elastic member 18 after release, especially if the sputter process produces a radius that is not the desired radius. This can be achieved by surrounding the elastic member with additional layers of metal that can be selectively etched away to alter the load on the released elastic member. Each time a layer is removed, the released elastic member will bend by a small amount, allowing the radius to be tuned. When the radius is tuned correctly, the processing can then continue onto the electroforming step. By making the layers thin and/or properly adjusting their stress, the amounts of radius change can be kept small, on the order of a few percent.

No added mask count is needed to implement radius tuning, because the selective nature of the etch defines the start and stop points of the layer removal. Further, no additional materials are needed, since the multilayers utilized can for example consist of the elastic member and seed metals (e.g. MoCr and Au) already used.

To make radius tuning compatible with plating, it must be ensured that after the radius is tuned, the surface exposes metal that can be plated. In the current industry practice, this means making bilayers of Au and MoCr, and etching down to the next layer of Au.

Figure 6:
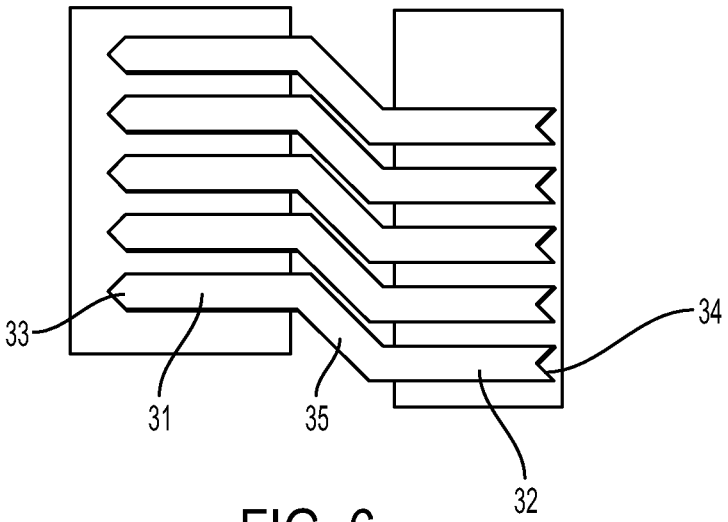
FIG. 6 is a top view of a layout of five mid-air elastic member pairs before release in accordance with some embodiments.
Figure 7:
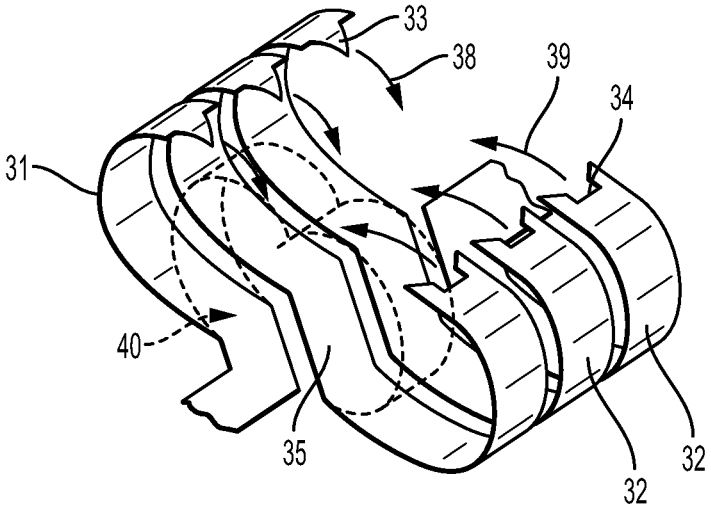
FIG. 7 is a partial perspective view of the member pairs of FIG. 6 during release.

An alternate method of forming an out-of-plane coil structure in which two half loops (half coil windings) are closed in mid-air forming a full coil winding is shown in FIGS. 6 and 7. The elastic layer is photolithographically patterned into a series of individual elastic members. Each individual elastic member includes a first elastic member 31, a contact portion or bridge for connecting between adjacent loop windings 35 and a second elastic member 32. First elastic member includes an end portion 33 in the shape of an elongated tip and second elastic member includes an end portion 34 having a groove for receiving elongated tip 33. This structure of tips 33 and 34 facilitates catching of the two half loops after release so that the two portions may be connected via soldering and/or plating. The loop winding is formed by removing the release window under each first elastic member and each second elastic member. This can be done at the same time, or sequentially, by using a release material under all the first elastic members different from under all the second elastic members. The first and second elastic members can also be released at different times by placing different perforation densities on them. This causes tip 33 to move in the direction of arrow 38 and tip 34 to move in the direction of 39. The elastic members 31, 32 may be connected by tethers 14. When the two tips meet, they are come together at point 40 to form coil windings. Free end 33 can be electrically connected to free end 34 during an electroplating process. Immersion in a plating bath and depositing metal on accessible metal surfaces both thickens all metal lines and connects free ends. The inventors have found that contaminants in the plating bath causes the electroplating process to also frequently results in deposition of plating material on the tethers creating electrically conductive bridges between the loops.

Figure 9:
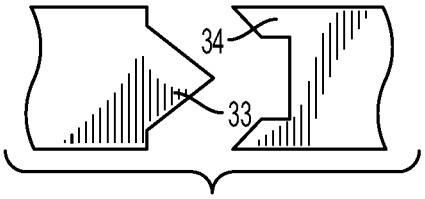
FIGS. 9 and 10 are top views of alternate elastic member tips in accordance with some embodiments.
Figure 10:
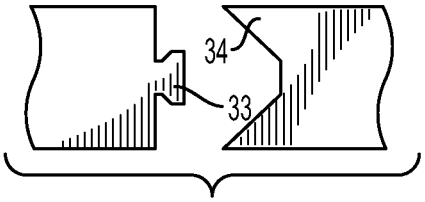

The elongated tips 33 may be, for example shaped as shown in FIG. 9 or FIG. 10. In addition to the shape shown in FIG. 7, end portion 34 may be of the shape shown in FIG. 10. Other variations are possible.

The individual loop halves are shown in FIGS. 6 and 7 as being of approximately the same length. However, the lengths can be varied to aid in the coil formation process. For example, the first elastic members can be made shorter than the second elastic members to ensure that the second elastic members overlap the first elastic members.

Figure 11:
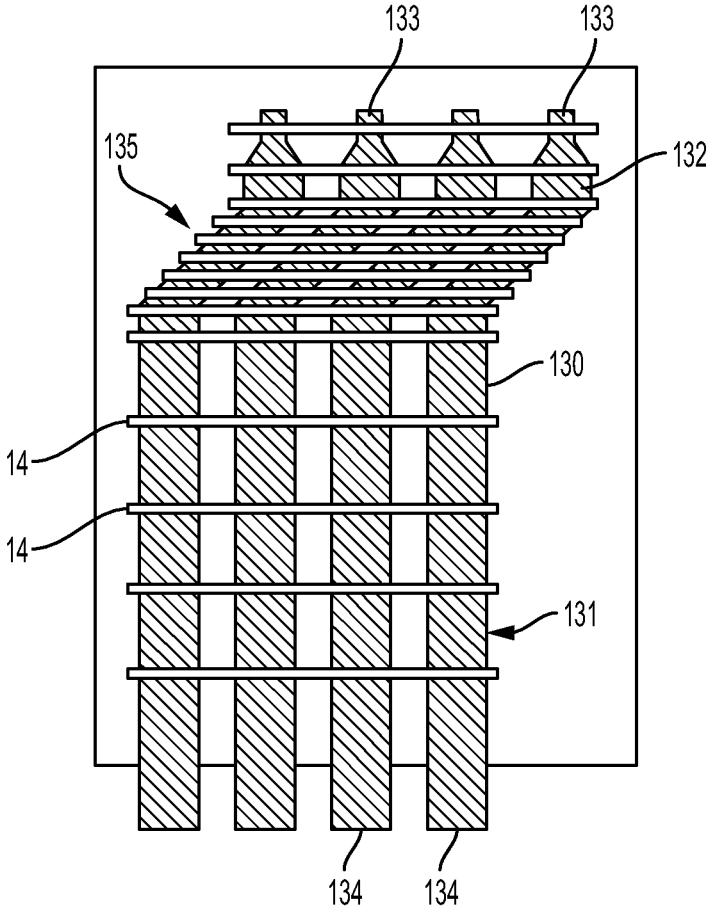
FIG. 11 is a top view of an alternate layout of four elastic members before release in accordance with some embodiments.

An alternative layout for a series of elastic members to be released to form a closed loop structure is shown in FIG. 11. In this embodiment, each elastic member 130 is patterned into two segments. The first segment 131 extends from anchor portion 134 until it reaches second segment 132. Second segment 132 is patterned at an angle from first segment 131 and is terminated by tip portion 133. One or more tethers 14 are added to maintain the spacing between the elastic members 130. When the release layer is removed, tip 133 is released followed by second segment 132 and then segment 131. When tip 133 contacts contact 134 of the adjacent member, the resulting loop is not acircular. The mid-air jog, which occurs where the first and second segments join 135, allows the free end 133 to return to the take-off point with an axial offset.

The resistance of the loop closure may be reduced by connecting the free end of a loop back to a contact pad on the substrate with low resistance. Obtaining low resistance at the contact pad requires a good metallurgical junction consisting of highly conducting materials. The free end may be joined to the contact pad by electroplating. In this method, the loop is formed by releasing the elastic member. The free end comes into either mechanical contact or proximity to a contact pad on the inductor substrate. Then, plating applies conducting material around both the free end and the contact pad, forming a continuous joint between them. In this embodiment, the application of material need not be limited to the free and the pad areas only. Preferably, the plated material has high conductivity, and is plated throughout the loop in order to reduce the coil resistance, thereby beneficially increasing the quality factor.

It is desired from a reliability standpoint to have as wide a pad area as possible in order to accommodate possible axial offsets of the loop ends with respect to their bases. This offset could for example be caused by helical bending due to stress anisotropies, or due to displacement of the fingers due to surface tension forces during wet processing.

Figure 12:
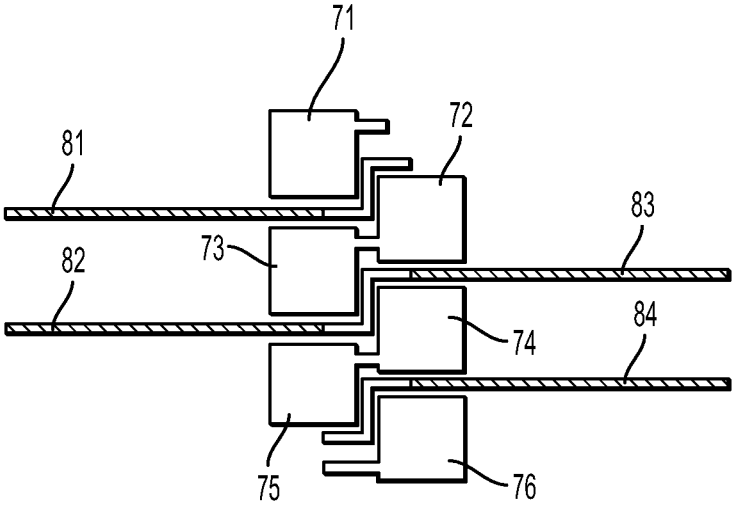
FIGS. 12 and 13 are top views of a bi-directional elastic member layout in accordance with some embodiments.
Figure 13:
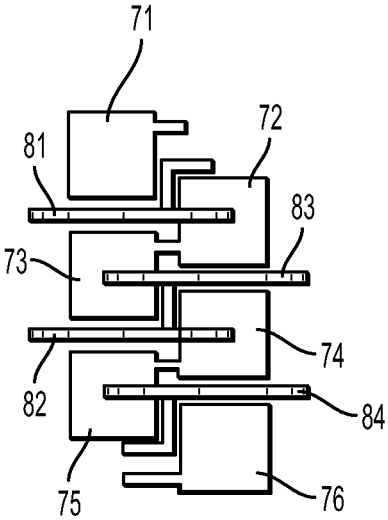

One possible way to extend the pad area is to release elastic members from opposite directions. This also enables the released elastic members to be made wider. FIG. 12 (before release) and FIG. 13 (after release) show a schematic of the layout. In FIG. 12, elastic members 81 and 82 are laid out to release from the left to the right. Elastic members 83 and 84 are laid out to release from right to left. Oversized contact pads 71, 72, 73, 74, 75 and 76 are also shown. This design is advantageous if the undercut can be minimized. A problem may arise in that the release window that opens to allow the elastic members to curl into loops, will also allow the release etch to advance toward the adjacent pad. Normally, the undercut etch of the release layer is about 30% larger than the undercut needed to release the elastic members. So, if the undercut needed is 20 microns, the undercut allowed for is about 25 microns. This may be too large in some cases.

A solution to the undercut problem is to clear the conducting release layer between the elastic member metal traces before applying the release window. This has the drawback that the release layer then cannot be as easily used as a common cathode for electroplating. The technique may work for electroless plating, however the conductance of electroless plated metals is typically lower than what is achievable with electroplating. Conductance has to be kept extremely high in order to meet the quality factor requirements of some applications.

Making the elastic members release from two sides and interleave does not permit the use of tethers since tethers would prevent interleaving. Without tethers, some stiffness and spacing rules may need to be made more conservative in order to prevent entanglement or shorting. Dense toroids designed to lift with their loop tips to the outside and landing pads to the center would not likely be a useful application of the bi-directional loops.

On-chip out-of-plane coil structures produced in accordance with the invention have numerous practical applications. For example, when produced with inductance values in the range of 1 to 100 nH, the out-of-plane inductor coil structures are optimally suited for use in mobile RF communication devices that operate in a frequency range of approximately 100 MHz to several GHz. In addition to their use as inductors, the out-of-plane coils can also be used as transformers. Micro-transformers are used in electronic components such as mixers, double-tuned filters and RF signal transformers. The out-of-plane coils are compatible with a variety of micro-transformer architectures. Examples of micro-transformer designs using the out-of-plane coils are described in the U.S. Pat. Nos. 6,856,225 and 6,392,524. Out-of-plane structures made in accordance with the invention may be used in any circuit formed on a substrate which has at least one reactance element. A reactance element is any capacitor, inductor or transformer.

Microfabricated three dimensional structures coated with a thick layer of electroplated metal may exhibit protruding nodules along the edge of the plated structures and/or may exhibit plating that extends along the tethers as discussed above. These protruding defects cause adjacent features to connect during the plating process leading to electrical shorts between the features. This disclosure discloses approaches for reducing electrical shorts and smoothing rough features in electroplated microfabricated devices. The approaches discussed herein take advantage of the scenario that application of a voltage on a sharp feature produces a more concentrated electric field relative to that produced by smoother features. When a voltage bias opposite that of normal electroplating processes is applied on an electroplated micro-fabricated structure immersed in an appropriate electrolytic solution, the rough areas on the electroplated film see higher electric fields than smoother areas. The reverse bias causes a reversal of the plating process, but preferentially removes materials from rough or protruding features. The end results are smoother surfaces, reduced nodule sizes, and reduction or elimination of electrical short circuits.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A method of forming an out of plane coil structure comprising:

depositing a layer of an elastic material on a substrate, the elastic material having an intrinsic stress profile;

photolithographically patterning the layer of elastic material into at least two spaced-apart elastic members;

forming an electrically non-conductive tether layer which joins the two elastic members;

undercut etching a portion of the substrate under the elastic members and the tether layer to release a free end of each of the elastic members and the tether layer from the substrate while leaving an anchor portion of each of the elastic members fixed to the substrate, the intrinsic stress profile in each of the elastic members biasing the free end of the elastic member away from the substrate to form a loop upon release of the free end, the tether layer maintaining the spaced apart position of the loops with respect to one another;

electroplating the out of plane structure by applying a voltage between an anode and the structure while the structure is in an electroplating bath; and subsequent to the electroplating, exposing the out of plane structure to an electrolytic solution and removing at least some of the plating metal from the electrically non-conductive tether layer by reversing a polarity between the anode and the structure in the electrolytic solution.

2. The method of claim 1, wherein the applied reversed polarity is pulsed.

3. The method of claim 1, wherein the electrolytic solution comprises phosphoric acid having a concentration in a range of about 80% to about 90%.

4. The method of claim 1, further comprising removing about 15% to about 20% of the plating metal from the loops.

5. The method of claim 1, further comprising removing about 400 nm to about 800 nm of the plating metal from the loops.

6. The method of claim 1, wherein removing the plating metal from the electrically non-conductive tether layer comprises reversing the polarity between the anode and the structure at a reverse current density of between about 10 $ma/cm^2$ and about 20 $ma/cm^2$ for a time period between about 0.5 and about 2.5 minutes.

7. The method of claim 1, wherein the elastic material is an electrically conductive material.

8. The method of claim 7, wherein electroplating the out of plane structure comprises connecting the free ends of the loops together or the anchor portion.

9. The method of claim 1, electrically connecting the loops in series to form a coil.

10. A method for forming an out of plane structure comprising:

depositing a layer of an elastic material on a substrate, the elastic material having an intrinsic stress profile;

photolithographically patterning the layer of elastic material into at least two spaced-apart elastic members;

forming an electrically non-conductive tether layer which joins the at least two elastic members;

undercut etching a portion of the substrate under the elastic members to release a free end for each of the elastic members from the substrate, while leaving an anchor portion for each of the elastic members fixed to the substrate, the intrinsic stress profile of the elastic members biasing the free ends of the elastic members away from the substrate forming loops such that on release of the free ends, the loops are maintained in spaced apart positions with one another;

electroplating the out of plane structure by applying a voltage between an anode and the structure while the structure is in a solution that includes a plating metal; and subsequent to the electroplating, reversing the polarity between the anode and the structure.

11. The method of claim 10, wherein the reversed polarity is pulsed.

12. The method of claim 10, wherein forward and reverse polarity is alternately applied in sequence.

13. The method of claim 10, wherein after reversing the polarity, a minimum distance between the adjacent loops is less than 100 μm.

14. The method of claim 10, wherein the out of plane structure is a coil having a Q factor greater than about 10.

15. The method of claim 10, where the plating metal comprises one or more of Cu, Ni and Au.

16. The method of claim 10, further comprising forming an electrically non-conductive tether layer which joins the at least two elastic members.

* * * * *